US005558239A

United States Patent [19]

Dubach

[11] Patent Number: 5,558,239

[45] Date of Patent: Sep. 24, 1996

[54] SNAP-ON, PLASTIC HINGED CLOSURE IN A SINGLE PIECE

[75] Inventor: Werner F. Dubach, Maur, Switzerland

[73] Assignee: Alfatechnic Patent AG, Switzerland

[21] Appl. No.: 335,705

[22] PCT Filed: Mar. 8, 1994

[86] PCT No.: PCT/CH94/00049

§ 371 Date: Jun. 26, 1995

§ 102(e) Date: Jun. 26, 1995

[87] PCT Pub. No.: WO94/20713

PCT Pub. Date: Sep. 15, 1994

[30] Foreign Application Priority Data

Mar. 9, 1993 [CH] Switzerland ..... 0705/93

[51] Int. Cl.[6] ..... B65D 47/08

[52] U.S. Cl. ..... 215/235; 215/237; 220/339

[58] Field of Search ..... 215/235, 237; 220/337, 338, 339, 340, 341, 342, 332, 333, 329, 334

[56] References Cited

U.S. PATENT DOCUMENTS

| | | | |
|---|---|---|---|
| 2,379,254 | 6/1945 | Rathbun | 220/333 |
| 3,628,215 | 12/1971 | Everburg | 220/339 X |
| 4,573,600 | 3/1986 | Dubach | 215/235 X |
| 4,703,853 | 11/1987 | Byrns | 220/339 X |
| 4,813,560 | 3/1989 | Begley | 215/235 |
| 5,007,555 | 4/1991 | Beck | 215/235 |
| 5,067,624 | 11/1991 | Thanisch | 215/235 |
| 5,115,931 | 5/1992 | Dubach | 215/235 X |
| 5,121,834 | 6/1992 | Tissembaum | 220/339 X |
| 5,148,912 | 9/1992 | Nozawa | 215/235 X |
| 5,405,007 | 4/1995 | Iwahashi | 220/339 X |
| 5,489,035 | 2/1996 | Fuchs | 215/235 |

FOREIGN PATENT DOCUMENTS

| | | | |
|---|---|---|---|
| 242753 | 9/1990 | Japan | 220/339 |

*Primary Examiner*—Allan N. Shoap
*Assistant Examiner*—Nathan Newhouse
*Attorney, Agent, or Firm*—Speckman, Pauley & Fejer

[57] ABSTRACT

A snap-on, plastic hinged closure in a single piece having a bottom part and a lid interconnected by an integral hinge in an area of superimposed outer walls of the bottom part and lid, as well as by at least one intermediate element that ensures the snap-on effect. The hinge includes at least two non-intersecting pivot axes. A pressure-resistant tilting element is arranged between two adjacent pivot axes, so that during opening or closing, the first bottom part and the tilting element, then the tilting element and the lid partially pivot around the corresponding pivot axis.

11 Claims, 3 Drawing Sheets

SNAP-ON, PLASTIC HINGED CLOSURE IN A SINGLE PIECE

BACKGROUND OF THE INVENTION

1. Field of the Invention

This invention relates to a one-piece snap-on plastic hinged closure, having a lower part and a lid, which are connected with each other with an integral joint in the area where the jacket walls of the lower part and the lid are superimposed on each other, as well as with at least one intermediate element which creates the snap effect.

2. Description of Prior Art

Snap-on plastic hinged closures of the type mentioned above are known in large numbers and multitudinous designs. Conventional plastic closures mainly include two basic elements. For one, they have a main joint around which the pivot movement of the lid in relation to the lower part takes place, and they furthermore have one or several intermediate elements creating the snap effect. Such intermediate elements can be in the form of straps, triangles or angled flexible springs or even longitudinally deformable tension spring elements.

The essential part of this invention is focused upon the design of the joint connecting the two parts, the lower part and the lid. This joint is typically embodied as a film hinge in one-piece, snap-on plastic hinged closures. In the completely closed or the completely opened state of the closure this film hinge is not subjected to a force. In all intermediate positions, compression and displacement forces are exerted on this film hinge. The formation of microscopic cracks and scores can be noted upon a close inspection. Stretching of the film hinge, as well as greatly spreading white fracture places can be clearly seen in the area of the film hinge. These conventional uniaxial hinges are stressed most in the range of the unstable equilibrium during each opening or closing operation. The forces generated by the intermediate elements do pull the two closure parts toward each other, but since they are not located vertically above each other in all intermediate positions which differ from the completely closed position, a reaction force is created which must be absorbed by the film hinge. If the tension forces are reduced in general, the life of the film hinge is extended, however, the snap effect of the closure is simultaneously and to a large extent lost.

The second problem with the design of the joint between the lower part and the lid is that the joint always projects out in relation to the jacket wall. That fact that this joint projects out in relation to the jacket walls is on the one hand the result of the geometry of the snap-on hinged closures and, on the other hand, it is done for reasons of manufacturing technology. The more the joint projects out in relation to the jacket wall, the greater is the snap effect of the closure and conversely this snap effect is reduced the less the joint projects out in relation to the jacket walls. Since customarily the snap hinges are injection-molded in the completely open position, a vertical wall of material remains in the injection mold below the joint. If the joint is designed to sit as closely as possible to the jacket walls, this wall of material in the injection mold becomes so thin that the service life of the injection mold is reduced and it becomes very prone to defects.

SUMMARY OF THE INVENTION

Therefore this invention has as one object to provide a one-piece, snap-on plastic hinged closure with a joint that is designed in such a way that the previously described disadvantages associated with conventional one-piece, snap-on plastic hinged closures are remedied to a large extent.

The above and other objects of this invention are achieved with a one-piece, snap-on plastic hinged closure having a lower part and a lid which are connected with each other with an integral joint in an area where jacket walls of the lower part and the lid are superimposed on each other. At least one intermediate element connected between the lower part and the lid creates a snap effect. The joint includes at least two adjoining pivot axes and a compression-resistant flip element positioned between the two adjoining pivot axes, so that during the closing or opening operation respectively, one sequential partially pivoting about one pivot axis occurs between the lower part and the flip element and a further partial pivoting around another pivot axis occurs between the flip element and the lid. Further advantageous embodiments ensue from the dependent claims which are discussed and further explained in the description which follows.

BRIEF DESCRIPTION OF THE DRAWINGS

One preferred embodiment of this invention as well as details of the design of the joint are illustrated in the drawings and explained in the description, wherein.

DESCRIPTION OF PREFERRED EMBODIMENTS

Figure 1:
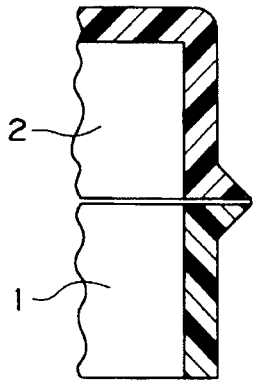
FIG. 1 (PRIOR ART)
FIG. 1 is a partial section taken through a film hinge of a conventional snap-on hinged closure in a closed position.
Figure 2:
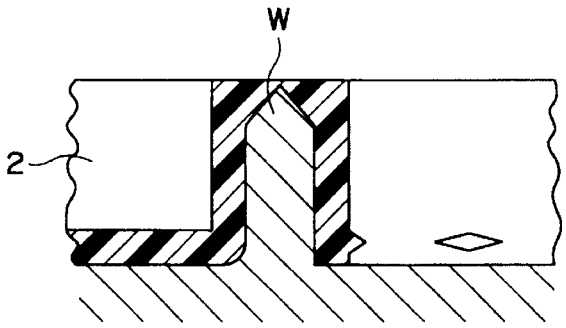
FIG. 2 (PRIOR ART)
FIG. 2 shows the view of FIG. 1, with the closure in a completely opened position.

No further reference will be made here to the two FIGS. 1 and 2 of the drawings, which represent a joint of a conventional snap-on hinged closure.

Figure 3:
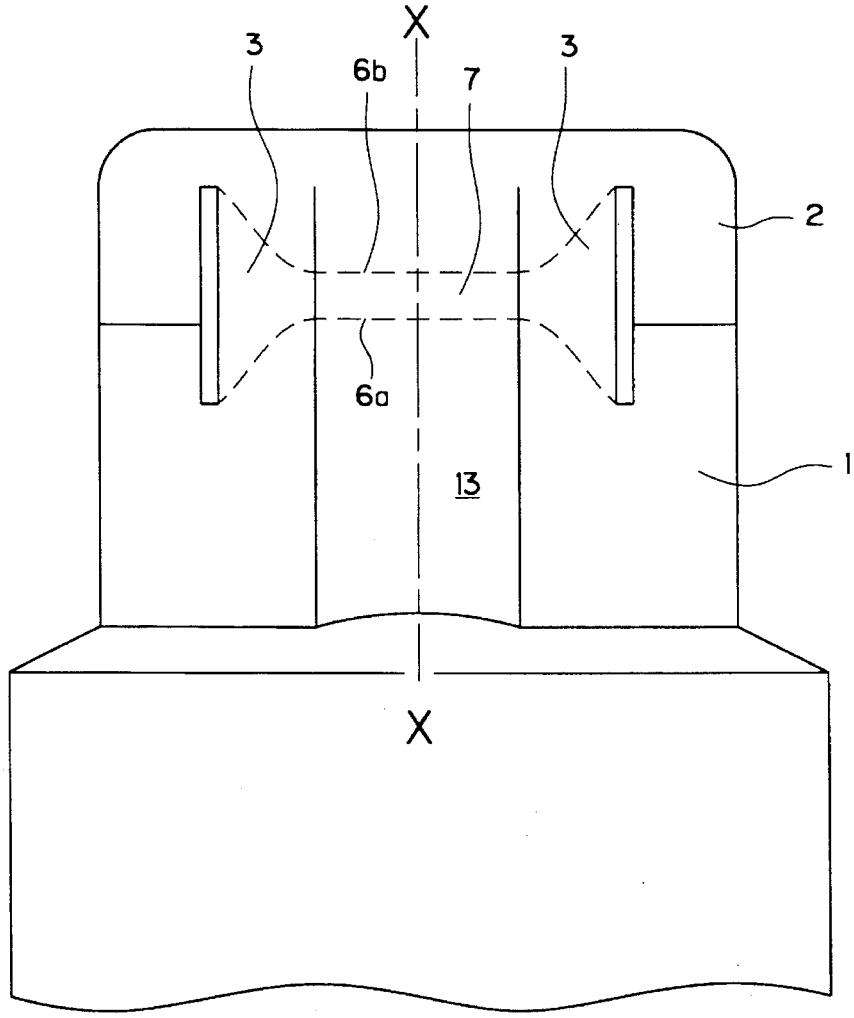
FIG. 3 is a front view of a snap-on hinged closure according to one preferred embodiment of this invention, mounted on a container, with a view of the joint.
Figure 4:
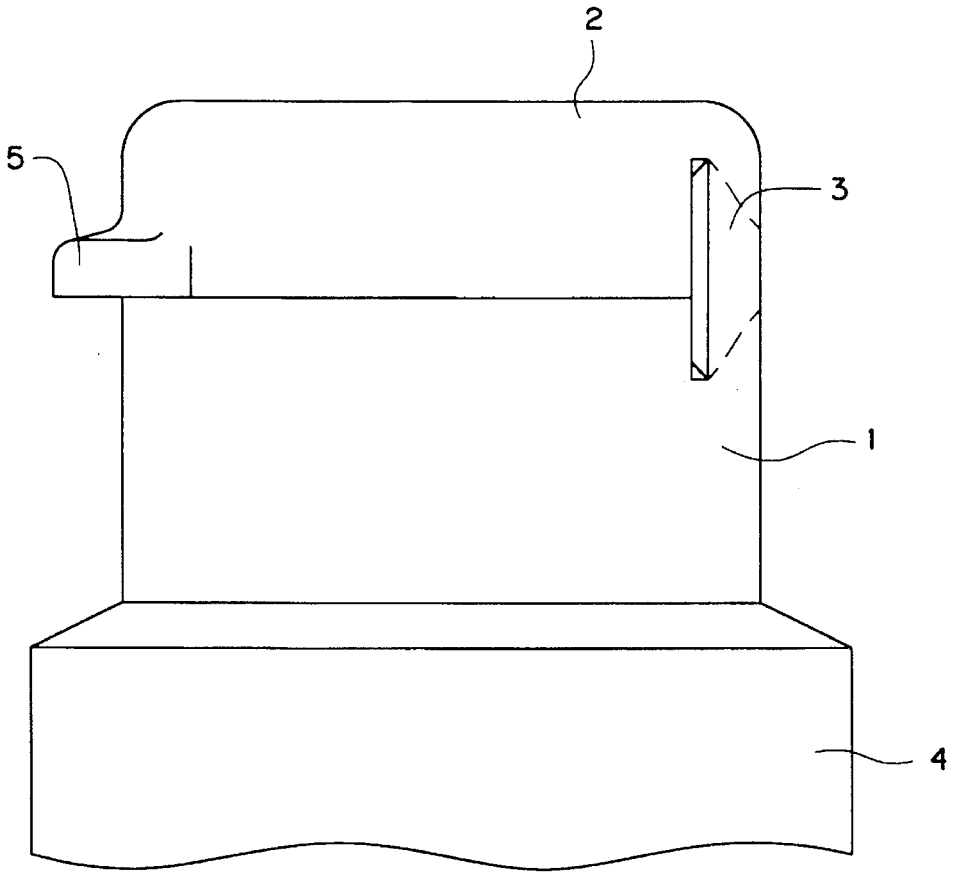
FIG. 4 is a side view of the closure shown in FIG. 3.

A snap-on hinged closure in a closed and mounted state is shown in FIG. 3. The lower part 1 of the closure is positioned on a neck, which is not shown in the drawings, of a container 4. The essentially cylindrical lower part 1 can be closed by a lid 2, as shown in FIG. 3. The lower part 1 and the lid 2 are connected with each other by the two triangular intermediate pieces 3 and are integrally formed together at two pivot axes *6a*, *6b* with the compression-resistant flip element 7 interposed between them. The two intermediate elements 3 are used to create a snap effect. In the closed state the entire snap hinge can hardly be seen from the outside. The two pivot axes 6*a*, 6*b* have been drawn as dash-dotted or phantom lines as extending straight and parallel to each other only for reasons of clarification. The jacket walls of the lower part 1 and of the lid 2 are flat in the area of the pivot axes 6*a*, 6*b* because of a flattening portion 13. A push element 5 is disposed on the lid 2 on the side of the closure opposite the hinge in order to make access for opening the closure easier, which is clearly seen in FIG. 4.

Figure 5:
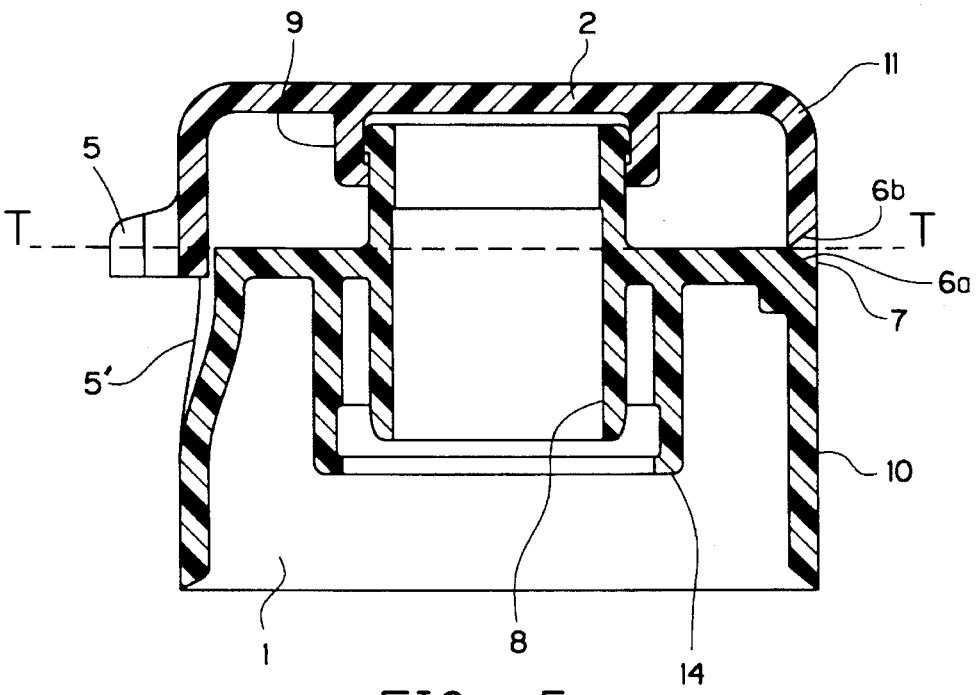
FIG. 5 shows a vertical section view taken through the closure of FIGS. 3 and 4, perpendicularly to a direction of pivot.

FIG. 5 shows a vertical section taken through the snap-on plastic hinged closure along the line X—X as shown in FIG. 3. The pouring spout 8, surrounded by a concentric outer wall 14, which can be clamped on a container neck, can also be seen in FIG. 5. An annular wall 9 which sealingly extends around the spout 8 is disposed on the inner surface of the lid 2. The compression-resistant flip element 7 can be seen, and it can also be clearly seen that the pivot axes 6*a*, 6*b* extend symmetrically in relation to a plane of separation T, indicated by a dashed line. It can further be seen that the pivot axes 6*a*, 6*b* are disposed within the jacket walls and thus form a non-protruding hinge, for the first time in this type of snap closures. The jacket wall of the lower part 1 is indicated by element reference numeral 10, the jacket wall of the lid 2 by element reference numeral 11.

Figure 6:
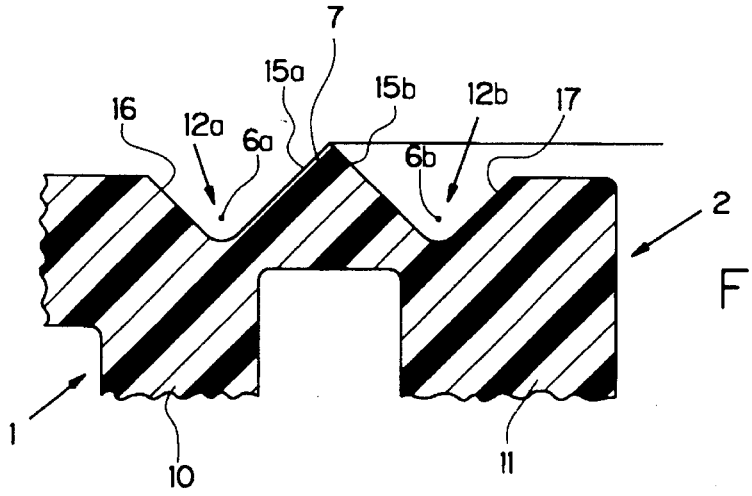
FIG. 6 shows an enlarged sectional view of a joint section, according to one preferred embodiment of this invention.

The particularly important joint of this invention is shown in FIG. 6 in an enlarged scale. The situation of the completely opened closure is illustrated in FIG. 6. It can be clearly seen that in a sectional view the flip element 7 has the general shape of an isosceles triangle. In the preferred embodiment shown in FIG. 6, the triangle is a right-angled isosceles triangle. Accordingly, the flip element 7 is bounded on both sides by the thin areas 12*a*, 12*b* , which define the pivot axes 6*a*, 6*b*, respectively. This roof-shaped compression-resistant flip element 7 thus forms a support surface 15*a* on one side and a support surface 15*b* on another side of the compression-resistant flip element 7. In the closed state of the closure, the one support surface 15*a* comes to rest on an inclined opposite surface 16 on the lower part 11, and the other support surface 15*b* comes to rest on an inclined opposite surface 17 on the lid 2. The opening angle between the support surface 15*a* and the opposite surface 16 on the lower part 11, as well as between the oppositely located support surface 15*b* and the opposite surface 17 on the lid 2 is respectively 90°. This permits the division of the pivot movement of the lid 2 with respect to the lower part 1 into respectively two pivot movements of respectively 90°.

Figure 7:
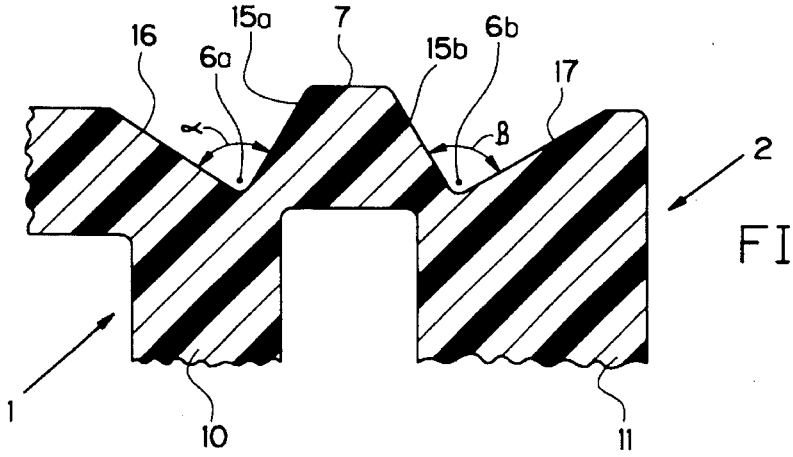
FIG. 7 shows an enlarged view of a joint section with a flip element, according to another preferred embodiment of this invention.

Basically, it is possible for the angle between the two support surfaces 15*a* and 15*b* to be less than 90°, however, this requires that the opposite surfaces 16 and 17 be designed somewhat flatter. The smaller the angle between the two support surfaces 15*a* and 15*b*, the more the flip element 7 would project into the closure. But since the portion of the support surfaces 15*a* and 15*b* projecting past the opposite surface 16 or 17 is ineffective, the triangular portion of the flip element 7 can be truncated, as illustrated in FIG. 7. This results in a flip element 7 which in cross section has the general shape of an isosceles trapezoid. Approximate right angles $\alpha,\beta$ which are to be maintained between the support surfaces 15*a* and 15*b* and the opposite surfaces 16 or 17 are also indicated in FIG. 7.

It is possible to apply two different angles, which would complement each other to form 180°, in place of the two right angles. But such embodiment results in an inclination of the flip element 7 in the completely closed position of the closure. This may be desirable in exceptional cases for specially designed closures.

It can also be seen in FIGS. 6 and 7 that the thin areas 12*a* and 12*b* forming the pivot axes 6*a*, 6*b* are situated inside of the jacket walls 10 or 11 of the lower part 1 or the lid 2.

When closing the closure of this invention, the lid 2 together with the flip element 7 is first pivoted around a pivot axis 6*a* between the support surface 15*a* and the opposite surface 16 on the lower part 1 until these two surfaces come to rest on each other, after which during pivoting over a further 90° the pivot movement around the second pivot axis 6*b* between the support surface 15*b* and the opposite surface 17 on the lid 2 takes place. These two pivot movements take place in a reversed manner during opening.

Figure 9:
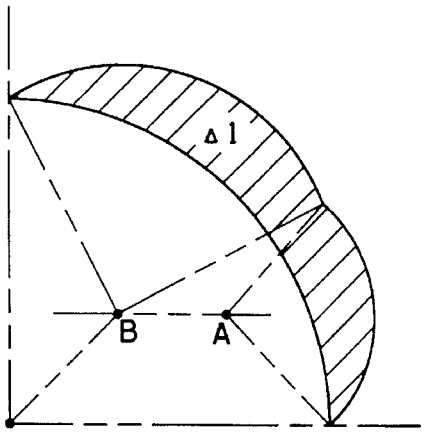
FIG. 9 shows a spring characteristic of a snap hinge, in accordance with one preferred embodiment of this invention, equipped with a joint.
Figure 8:
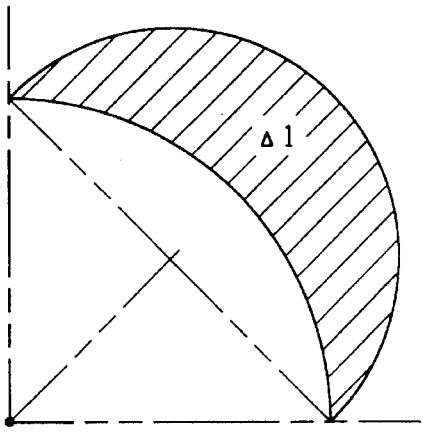
FIG. 8 (PRIOR ART)
FIG. 8 shows a spring characteristic of a conventional snap-on hinged closure in accordance with FIGS. 1 and 3.

If now the spring characteristics of conventional snap-on hinged closures and of the snap-on hinged closures of this invention are compared, the corresponding characteristic lines in FIGS. 8 and 9 result. FIG. 8 shows a conventional snap-on hinged closure with a joint having only one pivot axis 6, and it can be seen that in the area of dead center a maximal shape change of $\Delta 1$ occurs, while the snap-on hinged closure in accordance with this invention with two pivot axes 6*a*, 6*b* considerably reduces the maximal shape change. This results in a longer, relatively large pivot force over the entire pivot movement of the lid without, however, causing a deformation of such a size as with the uniaxial design of the joint. By means of this the complete opening of the lid over 180° is also assured. Up to now this has been only a desirable idea which, however, was never accomplished. Furthermore, by means of these graphics it is possible to explain that a considerably reduced maximum load is placed on the joint or the two pivot axes 6*a*, 6*b*, which results in a reduction of the formation of cracks and scores. Stretching or white fractures, which can be clearly seen by the naked eye when they occur in snap-on hinged closures in accordance with the state of the art, can hardly be detected in the closures of this invention.

I claim:

1. An integral plastic hinged snap closure having a lower part (1) and an upper part (2) connected with respect to each .other with an improved integral joint, the improved integral joint comprising:

said lower part (1) having a lower jacket wall (10), said lower jacket wall (10) having a lower thinned area (12*a*) of reduced wall thickness, a lower pivot axis (6*a*) oriented longitudinally along said lower thinned area (12*a*);

said upper part (2) having an upper jacket wall (11), said upper jacket wall (11) having an upper thinned area (12*b*) of reduced wall thickness, an upper pivot axis (6*b*) oriented longitudinally along said upper thinned area (12*b*);

the closure having a compression-resistant flip element (7) positioned between said lower pivot axis (6*a*) and said upper pivot axis (6*b*); and two snap elements (3), one of said snap elements (3) positioned on one side of said compression-resistant flip element (7) and another of said snap elements (3) positioned on an opposite side of said compression-resistant flip element (7), each said snap element (3) comprising said lower thinned area (12*a*) continuing within said lower jacket wall (10) away from said lower pivot axis (6*a*) and said upper thinned area (12*b*) continuing within said upper jacket wall (11) away from said upper pivot axis (6*b*), and in a direction away from said lower pivot axis (6*a*) and said upper pivot axis (6*b*) such that said continued lower thinned area (12*a*) and said continued upper thinned area (12*b*) are diverging with respect to each other.

2. An improved integral joint according to claim 1 wherein said lower thinned area (12*a*) is directed into said lower jacket wall (10) from an internal surface of said lower jacket wall (10).

3. An improved integral joint according to claim 1 wherein said upper thinned area (12*b*) is directed into said upper jacket wall (11) from an internal surface of said upper jacket wall (11).

4. An improved integral joint according to claim 1 wherein said lower thinned area (12*a*) and said upper thinned area (12*b*) are symmetric about a plane of separation (T) between said lower part (1) and said upper part (2).

5. An improved integral joint according to claim 1 wherein said lower thinned area (12*a*) defining said lower pivot axis (6*a*) is bound by an inclined lower wall surface (16) of said lower jacket wall (10) and an inclined element lower surface (15*a*) of said compression-resistant flip element (7).

6. An improved integral joint according to claim 5 wherein in an open position of said lower part (1) with respect to said upper part (2) an angle (α) formed between said lower wall surface (16) and said element lower surface (15*a*) is approximately 90°.

7. An improved integral joint according to claim 1 wherein said upper thinned area (12*b*) defining said upper pivot axis (6*b*) is bound by an inclined upper wall surface (17) of said upper jacket wall (11) and an inclined element upper surface (15*b*) of said compression-resistant flip element (7).

8. An improved integral joint according to claim 7 wherein in an open position of said lower part (1) with respect to said upper part (2) an angle (β) formed between said upper wall surface (17) and said element upper surface (15*b*) is approximately 90°.

9. An improved integral joint according to claim 7 wherein said lower thinned area (12*a*) defining said lower pivot axis (6*a*) is bound by an inclined lower wall surface (16) of said lower jacket wall (10) and an inclined element lower surface (15*a*) of said compression-resistant flip element (7).

10. An improved integral joint according to claim 1 wherein said compression-resistant flip element (7) has a cross section in a general shape of an isosceles triangle.

11. An improved integral joint according to claim 1 wherein said compression-resistant flip element (7) has a cross section in a general shape of an isosceles trapezoid.

* * * * *